US007219805B2

(12) United States Patent
DeMaison

(10) Patent No.: US 7,219,805 B2
(45) Date of Patent: May 22, 2007

(54) SIEVE SCREEN LEVEL SENSOR

(75) Inventor: Dale A. DeMaison, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 89 days.

(21) Appl. No.: 10/955,427

(22) Filed: Sep. 30, 2004

(65) Prior Publication Data

US 2005/0107922 A1 May 19, 2005

Related U.S. Application Data

(60) Provisional application No. 60/520,822, filed on Nov. 17, 2003.

(51) Int. Cl.
*B03B 9/00* (2006.01)

(52) U.S. Cl. ..... 209/246; 209/235; 209/240; 700/282; 399/253

(58) Field of Classification Search ..... 209/235, 209/240, 246, 243; 700/281, 282, 275, 301; 399/253, 251, 254
See application file for complete search history.

(56) References Cited

U.S. PATENT DOCUMENTS 3,591,003 A * 7/1971 Cooper ..... 210/90
4,514,306 A * 4/1985 Pato ..... 210/740
4,614,109 A * 9/1986 Hofmann ..... 73/38
5,006,227 A * 4/1991 Behm et al. ..... 209/143
5,071,541 A * 12/1991 Thompson ..... 209/2
5,541,831 A * 7/1996 Thomas ..... 700/28
5,943,231 A * 8/1999 Thomas ..... 700/28
6,070,738 A * 6/2000 Lyman et al. ..... 209/457
6,225,125 B1 * 5/2001 Lapidus ..... 436/63
6,905,594 B2 * 6/2005 Ferguson ..... 210/90
2003/0220717 A1 * 11/2003 Underwood et al. ..... 700/282
2005/0244193 A1 * 11/2005 Amano et al. ..... 399/258

* cited by examiner

*Primary Examiner*—Patrick Mackey
*Assistant Examiner*—Mark Hageman
(74) *Attorney, Agent, or Firm*—Lawrence P. Kessler

(57) ABSTRACT

Sieve screen level sensing in a filtering apparatus (10) for filtering fine powder material (M) which includes a sieve (12) having a material inlet (24) and a material outlet (26), and a sieve screen (14) is disposed within the sieve (12) between the material inlet (24) and outlet (26) such that the material (M) must pass through the sieve screen (14) to enter the material outlet (26) and thereby exit the sieve (12). An input valve (22) controls the flow of material (M) into the sieve (12) through the material inlet (24). A sieve screen level sensor assembly (20) senses a level of material (M) accumulated upon the sieve screen (14), and issues a level sense signal (66) indicative of that level. A programmable logic controller (60) receives the level sense signal (66) and controls the inlet valve (22) dependent at least in part thereon to thereby control the flow of material (M) into the material inlet (24).

3 Claims, 1 Drawing Sheet

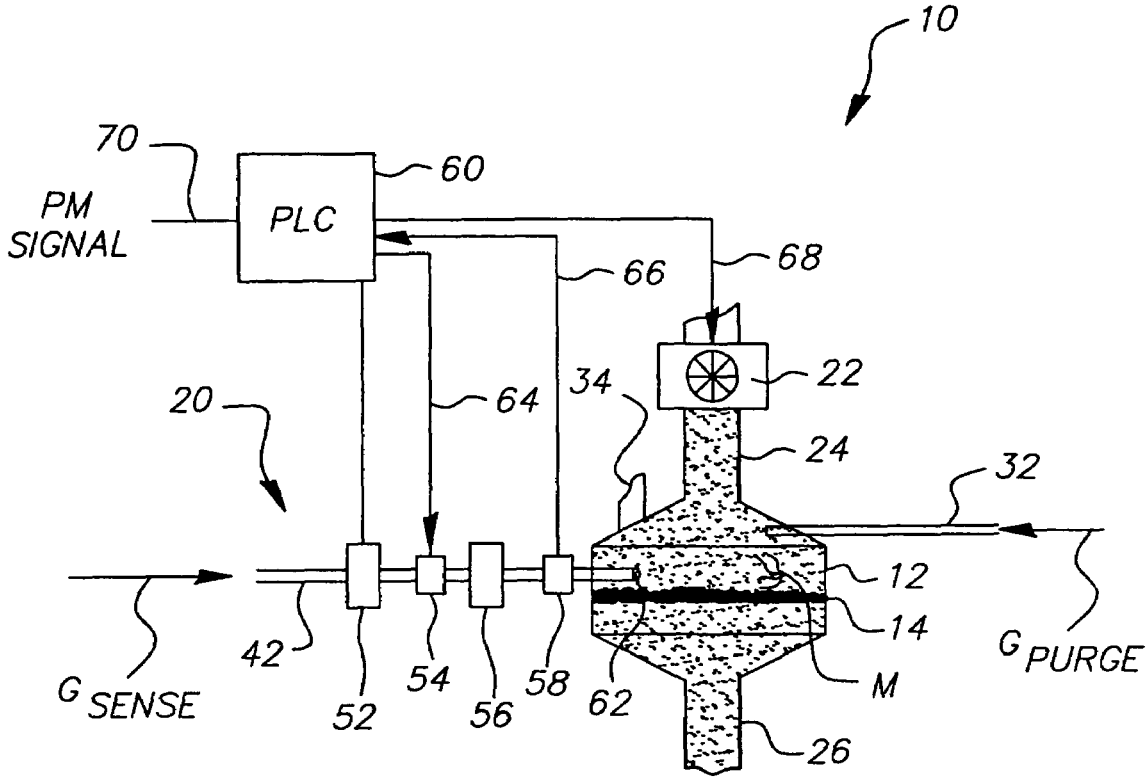
THE FIGURE

SIEVE SCREEN LEVEL SENSOR

CROSS REFERENCE TO RELATED APPLICATION

Reference is made to and priority claimed from U.S. Provisional Application Ser. No. 60/520,822, filed on Nov. 17, 2003, entitled: SIEVE SCREEN LEVEL SENSOR.

FIELD OF THE INVENTION

The present invention relates generally to the bulk handling of materials that are in the form of a fine powder or granulate. More particularly, the present invention is related to the process of sifting bulk toner, which is intended for use in electrographic copiers and printers, during or as part of the process of placing the toner into smaller containers.

BACKGROUND OF THE INVENTION

The toner used in electrographic copiers and printers is a blend of particles, including plastic resins, coloring pigments and other ingredients. Most toners are manufactured in bulk using a melt mixing or hot compounding process. Plastic resins, carbon black, magnetic iron oxides, waxes and charge control agents are blended together while in a molten state to thereby form a hot paste having a consistency similar to cake mix. This mixture is then cooled, typically by forming it into slabs on a cooling belt or by pelletizing the mixture and cooling the pellets. The raw toner is then ground or pulverized into a toner powder by jet mills or air-swept hammer mills. This process produces a powder having a wide range of particle sizes. The toner powder is sifted to remove over-size and under-size toner particles. The pulverized, sifted toner powder is then blended with additives to adjust flow and electrostatic properties. The finished toner powder has particle sizes that range from, for example, twelve microns (μ) to approximately eight microns and smaller. The bulk toner is typically placed into large-sized or bulk containers, such as, for example, large barrels.

The toner powder is typically repackaged from the large bulk containers into smaller intermediate or end-use containers that are suitable for sale to and/or use by end users. Repackaging the toner from the bulk containers into smaller containers generally involves gravity-assisted flow of the toner from the bulk container into a sieve, such as a vibratory sieve, and into the smaller containers. The sieve typically contains a mesh or screen filter through which the toner powder must flow. The filter is intended to prevent the passage of agglomerated toner particles and contaminants into the smaller containers. The mesh or screen filter has very fine openings, such as, for example, from approximately 200 to approximately 400 openings per inch, and is typically constructed of a metal, such as, for example, stainless steel.

The fine mesh filter occasionally becomes clogged or blinded due to an accumulation of agglomerated toner powder, oversized toner, and/or foreign particles thereon. The partial or complete clogging or blinding of the filter significantly reduces or stops the throughput of product through the screen, and a build-up of toner powder above the screen results. The weight of the built-up of toner powder bears directly upon the fine screen and may result in tearing of the screen. When a screen tears, the coarse material collected thereon is undesirably conveyed through the sieve thereby contaminating otherwise acceptable product. The contaminated product must be recycled, i.e., re-processed through the sieve.

In order to prevent the above-described overloading and tearing of sieve screens, the sieves must be shut down and preventive maintenance and cleaning of the screens performed. The performance of such preventative maintenance, and the resulting down time of the sieves, is costly and inefficient. Further, the preventive maintenance must be performed on a predicted minimum schedule, which may often be premature for a particular screen, thereby causing unnecessary down time of the sieves.

Therefore, what is needed in the art is a method and apparatus to detect a build-up of powder on the screen.

Further, what is needed in the art is a method and apparatus for detecting a blinded or clogged screen thereby indicating the need for cleaning and/or preventive maintenance.

Moreover, what is needed in the art is a method and apparatus that prevents overloading and/or tearing of filter screens, and which increases the useful life of a filter screen.

SUMMARY OF THE INVENTION

The present invention provides a filtering apparatus for filtering fine powder, and which reduces the occurrences of and/or detects torn and/or blinded sieve screens.

The invention provides, in one form thereof, a sieve having a material inlet and a material outlet. An inlet valve controls the flow of material into the sieve through the material inlet. A sieve screen is disposed within the sieve between the material inlet and outlet such that the material must pass through the sieve screen to enter the material outlet and thereby exit the sieve. A sieve screen level sensor assembly senses a level of material accumulated upon the sieve screen, and issues a level sense signal indicative of that level. A programmable logic controller receives the level sense signal and controls the inlet valve dependent at least in part thereon to thereby control the flow of material into the material inlet.

An advantage of the present invention is that a build-up of material on the sieve screen or a blinded sieve screen is detected to thereby reduce the occurrence of torn sieve screens.

A further advantage of the present invention is that a blinded or clogged screen is detected and the need for cleaning and/or preventive maintenance of the sieve screen is indicated, thereby avoiding premature preventative maintenance and/or cleaning.

A still further advantage of the present invention is the overloading and/or tearing of filter screens is reduced, thereby increasing the useful life of a sieve screen.

The invention, and its objects and advantages, will become more apparent in the detailed description of the preferred embodiment presented below.

BRIEF DESCRIPTION OF THE DRAWINGS

The above-mentioned and other features and advantages of this invention, and the manner of attaining them, will become apparent and be better understood by reference to the following description of one embodiment of the invention in conjunction with the accompanying drawings, wherein:

The FIGURE is a schematic diagram of one embodiment of an apparatus for filtering fine powder having a sieve screen level sensor of the present invention.

The exemplifications set out herein illustrate one preferred embodiment of the invention, in one form, and such exemplifications are not to be construed as limiting the scope of the invention in any manner.

DETAILED DESCRIPTION OF THE DRAWINGS

Referring now to the FIGURE, one embodiment of a bulk powder filtering or sifting apparatus having a sieve screen level sensor of the present invention is shown. Bulk powder filtering apparatus 10 includes sieve 12, sieve screen 14, sieve screen level sensor assembly 20, and input valve 22.

Sieve 12 is a conventional material or powder sieve, such as, for example, a vibratory sieve manufactured by Russell Finex Corporation, intended to sift or sieve a fine bulk powder material M, such as, for example, toner, carbon, silica, alumina, plastic resins, etc. Sieve 12 includes an inlet 24 and an outlet 26. Input valve 22, such as, for example, a conventional rotary air lock valve, controls the flow of powder material M through inlet 24 and into sieve 12. Powder material M exits sieve 12 through outlet 26. Sieve screen 14 is disposed between inlet 24 and outlet 26.

A flow of pressurized gas $G_{PURGE}$, such as, for example, air, nitrogen, or another inert gas, is supplied via a purge gas supply line or conduit 32 to the interior of sieve 12. Typically, purge gas $G_{PURGE}$ is an inert gas supplied through purge gas supply line 32 and into sieve 12 that is used to purge sieve 12 of air, and to blanket any cloud of powder particles existing therein to inhibit combustion and/or explosion. The flow of air and/or purge gas $G_{PURGE}$ through purge gas supply line 32 and into sieve 12 is at a purge gas pressure $P_{PURGE}$, such as, for example, from approximately 1.0 to 3.0 inches water column (In. WC). A purge vent 34 vents the inside of sieve 12 to other interconnected processing devices (not shown), such as, for example, a recycling or filtering apparatus to remove and recycle powder from the gas that is being vented from sieve 12.

Generally, sieve screen level sensor assembly 20 senses a level of material M upon or above sieve screen 14, and slows or discontinues the flow of powder material M into sieve 12 when that level exceeds a predetermined threshold level. When the sensed level of material M falls below a predetermined threshold level and/or preventive maintenance on sieve screen 14 is performed the flow of powder material M into sieve 12 is returned to full speed/volume and/or resumed.

Sieve screen level sensor assembly 20 is associated with and includes a conduit or sensing gas supply line 42 that supplies a sensing gas $G_{SENSE}$ to sieve 12. Further, sieve screen level sensor assembly 20 includes pressure regulator 52, sense gas control valve 54, flow meter 56, pressure switch 58, and a programmable logic controller (PLC) 60.

Sensing gas supply line 42 provides flow of sensing gas $G_{SENSE}$ to sieve 12. More particularly, sensing gas $G_{SENSE}$ flows from a source (not shown) through sensing gas supply line 42, out orifice 62 thereof, and into sieve 12. Orifice 62 has a predetermined dimension (radius or area) and is disposed at a predetermined level or height, such as, for example from approximately 0.25 to approximately 1.0 inches or more, above the inlet side (not referenced) of sieve screen 14 (i.e., the side of sieve screen 14 closest to or facing material inlet 24). Preferably, orifice 62 is oriented such that a centerline (not shown) of orifice 62 is parallel relative to sieve screen 14. Of course, those of ordinary skill in the art will recognize that the level (and orientation) at which orifice 62 is disposed relative to sieve screen 14 is dependent upon many factors and will vary depending upon the parameters of any particular application of the sieve screen level sensor assembly 20 of the present invention.

One or more pressure or flow regulators 52 (only one shown) are operably associated with sensing gas supply line 42, and regulate the pressure of sensing gas $G_{SENSE}$ therein. Typically, flow regulator 52 steps down or regulates the pressure of sensing gas $G_{SENSE}$ at a sensing pressure $P_{SENSE}$. Sensing pressure $P_{SENSE}$, such as, for example, from approximately 4 to approximately 7 In.WC, is a predetermined amount greater than $P_{PURGE}$.

Sense gas control valve 54 is operably associated with sensing gas supply line 42. Sense gas control valve 54 is electrically connected to PLC 60 and receives therefrom sense gas control signal 64. Sense gas control valve 54 is responsive, i.e., opens and/or closes, to sense gas control signal 64 to thereby control the flow of sensing gas $G_{SENSE}$ through sensing gas supply line 42. Thus, sense gas control valve 54 controls the flow of sensing gas $G_{SENSE}$ through sensing gas supply line 42 and into sieve 12, and thereby the flow of sensing gas $G_{SENSE}$ is shut off during shutdown and/or preventive maintenance of bulk powder filtering apparatus 10. Sense gas control valve 54 is a conventional and commercially-available valve, such as, for example, a solenoid-operated valve suitable for use in low-pressure applications.

Flow meter 56 is also operably associated with sensing gas supply line 42. Flow meter 56 measures, and thereby provides a visual indication of, the flow of sensing gas $G_{SENSE}$ through sensing gas supply line 42. Flow meter 56 is a conventional and commercially-available flow meter capable of measuring a range of flow from approximately 4 to approximately 50 standard cubic feet per hour (scfh), such as, for example, model RMB-52-BV manufactured by Dwyer Instruments, Inc. of Michigan City, Ind.

Pressure switch 58 is also operably associated with sensing gas supply line 42. Pressure switch 58 detects an increase or rise in sensing pressure $P_{SENSE}$ above a certain level or predetermined threshold as will be more particularly described hereinafter. Pressure switch 58 issues level sense signal 66 to PLC 60 when $P_{SENSE}$ equals and/or exceeds that predetermined threshold. Pressure switch 58 is also a conventional and commercially-available large-diaphragm or low-pressure pressure switch having a range of approximately 1.0 to 4.0 In.WC, such as, for example, Model No. 1640-2 also manufactured by Dwyer Instruments, Inc. of Michigan City, Ind.

PLC 60 is a conventional programmable logic control. PLC 60 is electrically connected with and issues sense gas control signal 64 to sense gas control valve 54. As discussed above, sense gas control valve 54 is responsive to sense gas control signal 64, i.e., the valve opens and/or closes in response to sense gas control signal 64, to thereby control the flow of sensing gas $G_{SENSE}$ through sensing gas supply line 42. PLC 60 is also electrically connected with and receives level sense signal 66 from pressure switch 58. As also discussed above, pressure switch 58 issues level sense signal 66 to PLC 60 when $P_{SENSE}$ equals and/or exceeds a predetermined threshold. PLC 60 is further electrically connected with and issues an input valve control signal 68 to input valve 22. Responsive to input valve control signal 68, input valve 22 controls the flow of material M through inlet 24 and into sieve 12. Although not shown, PLC 60 may monitor and control various other functions within bulk powder filtering apparatus 10.

In steady-state use, input valve 22 provides a generally constant and continuous rate of flow of material M through inlet 24 and into sieve 12. Material M then drops onto sieve screen 14. As those skilled in the art will appreciate, a given input flow rate of material M having known properties, such as, for example, particle size, will flow through sieve screen 14, also having known properties, such as, for example, mesh size, at a predictable and/or known rate that is generally if not substantially constant. Thus, the desired flow rate of material M through inlet 24 of sieve 12 is predetermined and established through the control of input valve 22 via PLC 60 and input valve control signal 68 issued thereby. The desired flow rate ensures that material M does not accumulate or back-up on sieve screen 14 in quantities or weights sufficient to blind or tear sieve screen 14. Also in steady-state use, and as described above, sensing pressure $P_{SENSE}$ is established and regulated at a level that is a predetermined amount greater than purge pressure $P_{PURGE}$.

Also in steady-state use, and as described above, sieve 12 is pressurized with purge gas $G_{PURGE}$ at a purge gas pressure $P_{PURGE}$, such as, for example, from approximately 1.0 to 3.0 In.WC. Similarly, sensing gas $G_{SENSE}$ flows through sensing gas supply line 42, out orifice 62 thereof, and into sieve 12 at a sensing pressure $P_{SENSE}$, such as, for example, from approximately 4 to approximately 7 In.WC. Thus, sensing pressure $P_{SENSE}$ is a predetermined amount greater than purge gas pressure $P_{PURGE}$. Sensing pressure $P_{SENSE}$ is maintained at a level that is a predetermined amount greater than purge pressure $P_{PURGE}$ to reduce the likelihood that a rise or spike in purge gas pressure $P_{PURGE}$ equals or exceeds sensing pressure $P_{SENSE}$, thereby reducing the likelihood of a false indication of a reduced or blocked flow of sensing gas $G_{SENSE}$.

As agglomerated particles of material M, other coarse and/or foreign particles accumulate upon sieve screen 14, the rate of flow of material M through sieve screen 14 is adversely affected. Typically, the adverse affect that occurs is a relatively gradual decrease in the rate of flow of material M through sieve screen 14. However, relatively drastic decreases in the rate of flow of material M through sieve screen 14 also occur. In any event, whether the adverse affect takes the form of a gradual or a relatively drastic decrease in the rate of flow of material M through sieve screen 14, the decrease in the rate of flow of material M through sieve screen 14 is generally difficult to predict or forecast, is highly variable, and is dependent upon many factors. Thus, in conventional sieve screening systems the sieve screens may be torn or preventive maintenance is performed at a less-than-optimal interval. The sieve screen level sensor assembly 20 of the present invention, however, detects such a build-up of material M on sieve screen 14 and reduces or stops the flow of material M into sieve 12 to thereby reduce the incidence of torn screens and/or signal the need for timely preventive maintenance.

More particularly, as agglomerated particles of material M and other coarse or foreign particles accumulate upon sieve screen 14, thereby reducing the rate of flow of material M therethrough, material M begins to accumulate upon sieve screen 14. When the level of accumulated material M rises to the level of orifice 62, the flow of sensing gas $G_{SENSE}$ therethrough is restricted or substantially blocked. Thus, the pressure of sensing gas $G_{SENSE}$ within sensing gas supply line 42 increases above sensing pressure $P_{SENSE}$. When the pressure of sensing gas $G_{SENSE}$ within sensing gas supply line 42 exceeds $P_{SENSE}$ by a predetermined threshold, pressure switch 58 issues or activates level sense signal 66 which is received by PLC 60. Responsive thereto, PLC 60 issues or activates input valve control signal 68 which is received by input valve 22. Responsive to input valve control signal 68, input valve 22 slows or stops the flow of material M into sieve 12 and, thus, onto sieve screen 14.

The continued operation of sieve 12 with the flow of material M reduced or stopped will clear the accumulated material M from screen 14 in a relatively brief time period when sieve screen 14 is only partially blocked or merely backed-up, and will thereby cause material M to drop below the level of orifice 62. Thus, sensing gas $G_{SENSE}$ will again flow normally and in a relatively unrestricted manner through sensing gas supply line 42. The pressure of sensing gas $G_{SENSE}$ therefore returns to sensing pressure $P_{SENSE}$, and pressure switch 58 resets. Upon the reset of pressure switch 58, level sense signal 66 also resets or returns to its default or inactive state. Responsive to the resetting of level sense signal 66, PLC 60 deactivates or resets input valve control signal 68 to thereby return input valve 22 to normal operation, or to an intermediate or restarting mode of operation for resuming the flow of material M into sieve 12.

The continued operation of sieve 12 with the flow of material M reduced or stopped will only gradually, if at all, clear the accumulated material M from screen 14 when sieve screen 14 is substantially blocked or blinded. Thus, the level of material M upon sieve screen 14 decreases, if at all, at a very gradual rate. PLC 60 is configured to issue or activate sense gas control signal 64 and a preventative maintenance signal PM signal 70 upon the expiration of a predetermined period of time following the activation of level sense signal 66 (indicating a backed-up condition). Responsive to sense gas control signal 64 being activated, sense gas control valve 54 stops the flow of sense gas $G_{SENSE}$ through sense gas supply line 42 in preparation for the shut-down and preventative maintenance of bulk powder filtering apparatus 10. PM signal activates an indicator or alarm, such as for example, a red light or audible buzzer, to alert maintenance personnel to the need for maintenance to be performed on bulk powder filtering apparatus 10. PLC 60 is further programmed to shut down bulk powder filtering apparatus 10 in such a situation to enable maintenance personnel to commence preventative maintenance and/or cleaning of apparatus 10 and sieve screen 14.

It should be particularly noted that during normal operation of sieve 12 and sieve screen level sensor assembly 20, material M can migrate into and upstream within sensing gas supply line 42. Such migration may result in accumulation of material M within sensing gas supply line 42, thereby reducing the inside diameter thereof and causing an increase in sensing the pressure of sensing gas $G_{SENSE}$ flowing therein. Such a condition may, if the pressure of sensing gas $G_{SENSE}$ within sensing gas supply line 42 exceeds pressure $P_{SENSE}$, result in a false indication of a blocked sieve screen 14. Flow meter 56 provides a visual indication of the flow of sensing gas $G_{SENSE}$ through sensing gas supply line 42, and is monitored (manually or automatically monitored, such as, for example, by PLC 60) to indicate when an accumulation of material M is present in an amount sufficient to require cleaning and/or preventative maintenance of sensing gas supply line 42.

While this invention has been described as having a preferred configuration, the present invention can be further modified within the spirit and scope of this disclosure. This application is therefore intended to cover any variations, uses, or adaptations of the present invention using the general principles disclosed herein. Further, this application is intended to cover such departures from the present disclosure as come within the known or customary practice in the art to which this invention pertains and which fall within the limits of the appended claims.

PARTS LIST

10. Filtering Apparatus
12. Sieve
14. Sieve Screen
20. Sieve Screen Level Sensor Assy.
22. Input Valve
24. Material Inlet
26. Material Outlet
32. Purge Gas Supply Line
34. Purge Vent
42. Sensing Gas Supply Line
52. Pressure Regulator
54. Sense Gas Control Valve
56. Flow Meter
58. Pressure Switch
60. Programmable Logic Ctrl.
62. Orifice
64. Sense Gas Control Sig.
66. Level Sense Signal
68. Input Valve Control Sig.
70. PM Signal
M—Powder Material
$G_{PURGE}$—Purge Gas $G_{SENSE}$—Sense Gas
$P_{PURGE}$—Purge Gas Pressure $P_{SENSE}$—Sense Gas Pressure

What is claimed is:

1. A filtering apparatus for filtering fine powder material, comprising:

a sieve having a material inlet and a material outlet;

an input valve selectively providing a flow of material into said sieve through said material inlet;

a sieve screen disposed within said sieve with said material inlet on one side of said sieve screen generally facing said material inlet and said material outlet on the opposite side of said sieve screen generally facing said material outlet such that the material must pass through said sieve screen to enter said material outlet and thereby exit said sieve;

a sieve screen level sensor assembly sensing a level of material accumulated upon said sieve screen and issuing a level sense signal indicative of said level, a sense gas supply line having an orifice, said orifice disposed within said sieve intermediate said material inlet and said sieve screen, said orifice being spaced a predetermined distance from said sieve screen, sense gas flowing at a sense pressure through said sense gas supply line and through said orifice, a pressure switch associated with said sense gas supply line, said pressure switch sensing a pressure of said sense gas in said sense gas supply line, said pressure switch activating said level sense signal when the pressure of sense gas in said sense gas supply line exceeds said sense pressure by a first predetermined threshold, and resetting said level sense signal when the pressure of sense gas in said sense gas supply line falls below a second predetermined threshold; and a progammable logic controller receiving said level sense signal and controlling said input valve dependent thereon to thereby control the flow of material into said material inlet in order to prevent screen damage due to build up of material on said sieve screen, and wherein said programmable logic controller activates at least one of a sense gas control signal and a preventive maintenance signal when said level sense signal is not reset within a predetermined period of time following the activation thereof.

2. The filtering apparatus of claim 1, further comprising a flow of purge gas into said sieve, said purge gas having a purge pressure, said sense pressure being a predetermined amount greater than said purge pressure.

3. The filtering apparatus of claim 1, wherein said sieve is a vibratory sieve.

* * * * *

UNITED STATES PATENT AND TRADEMARK OFFICE

CERTIFICATE OF CORRECTION

PATENT NO. : 7,219,805 B2
APPLICATION NO. : 10/955427
DATED : May 22, 2007
INVENTOR(S) : Dale A. DeMaison It is certified that error appears in the above-identified patent and that said Letters Patent is hereby corrected as shown below:

| | |
|---|---|
| Column 8, line 7, Claim 1 | After “screen” insert --a-- |
| Column 8, line 20, Claim 1 | Delete “programmable” and insert --programmable-- |

Signed and Sealed this

Fourteenth Day of August, 2007

JON W. DUDAS
*Director of the United States Patent and Trademark Office*